United States Patent [19]

Kummerman

[11] 4,193,439

[45] Mar. 18, 1980

[54] DEVICE FOR OPERATING HATCH COVERS OR THE LIKE COMPOSED OF PANELS

[75] Inventor: Henri Kummerman, Geneva, Switzerland

[73] Assignee: MacGregor International S.A., Basel, Switzerland

[21] Appl. No.: 858,349

[22] Filed: Dec. 7, 1977

[30] Foreign Application Priority Data

Dec. 9, 1976 [FR] France ..... 76 37111
Nov. 30, 1977 [FR] France ..... 77 36151

[51] Int. Cl.[2] ..... B63B 19/20
[52] U.S. Cl. ..... 160/188; 114/201 R
[58] Field of Search ..... 160/188; 114/201-203

[56] References Cited

U.S. PATENT DOCUMENTS

| | | | |
|---|---|---|---|
| 3,107,722 | 10/1963 | Larsson | 160/188 |
| 3,169,502 | 2/1965 | Groppell | 160/188 |
| 3,190,637 | 6/1965 | Kummerman | 160/188 |
| 3,795,217 | 3/1974 | Kloess et al. | 160/188 |
| 3,811,396 | 5/1974 | Wessel et al. | 114/201 R |

*Primary Examiner*—Peter M. Caun
*Attorney, Agent, or Firm*—Kenyon & Kenyon

[57] ABSTRACT

An operating device for handling a cover for a hatch of the type composed of at least three successive cover panels hingedly connected to one another comprising first operating means for partially folding the first and second cover panels, and other operating means for folding the third cover panel, constituted by at least one articulated lever located outside the rolling track defined by the coaming rails or bars on which the rollers of the second and third cover panels move.

20 Claims, 14 Drawing Figures

DEVICE FOR OPERATING HATCH COVERS OR THE LIKE COMPOSED OF PANELS

Figure 1:
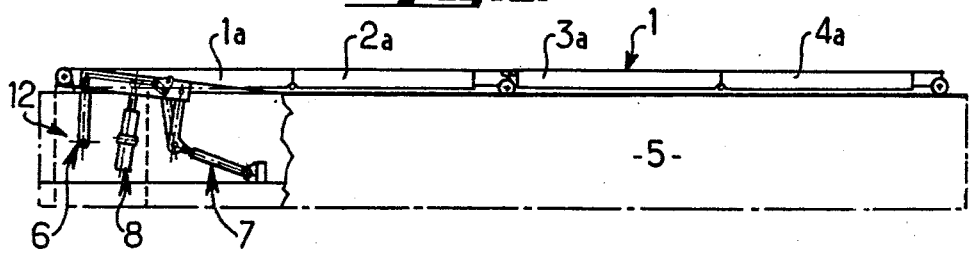

The present invention has essentially for its object a device for operating hatch covers on ships or access openings in other type of vehicles, buildings or stationary structures, as well as the various applications and uses thereof and the systems, assemblies, outfits and installations provided with such devices.

In a manner known per se, a hatch cover can be divided into several cover panels or sections adapted to be actuated between a hatch closing or covering position where the said cover panels rest on a coaming surrounding the hatch opening, and a stowage or hatch opening position where the said cover panels are stowed in proximity to one another in substantially parallel positions.

Various presently known hatch-cover operating devices are essentially constituted by hydraulic or pneumatic actuators or fluid-operated cylinders and/or chains which suffer from disadvantages which the present invention is intended to remedy.

Among such disadvantages mention can be made of the fact that some devices, such as those provided with chains, are mounted externally to the hatch cover on the two mutually opposite side-walls of the hatch coaming, resulting in the necessity of providing along the coaming side-walls a longitudinal band of permanently free or cleared space, due to the fact that such chain devices are movable along the coaming side-walls. Moreover, such chain devices are relatively complex.

In other devices, e.g. those using actuators, the outer surfaces of the mutually opposite hatch-coaming side-walls are left free, but such devices are partially arranged above the hatch cover panels or sections, and this, in the case of hydraulic devices, may be disadvantageous to the goods in the ships hold which are located at the level of the periphery of the hatch, due to the fact that the leakage of oil or the like which may occur in such hydraulic devices may damage the goods.

The invention is directed at obviating both types of disadvantages by providing a device entirely outside the periphery of the hatch and partially at one end of the latter so that it does not project from the coaming side-walls.

The invention therefore has for its object an operating device for actuating the cover of a hatch or like access opening, of the type composed of at least three successive cover panels or sections hingedly connected to one another, between a first, hatch closing or covering position, in which the cover panels rest upon a coaming or the like surrounding the hatch opening and are substantially arranged in a common plane, and a stowage position at one end of the hatch opening, in which the cover panels are stowed in proximity to one another in substantially parallel positions, comprising first, e.g. hydraulic, operating means for partially folding the first two cover panels, and operating, e.g. hydraulic, means for folding the third cover panel, constituted by at least one hinged lever, characterized in that the said lever is located outside the rolling track defined by the coaming upper-edge rails or bars on which the rollers of the second and third cover panels move.

According to another feature of the invention, the various operating means are essentially constituted by hydraulic or pneumatic actuators or fluid-actuated cylinders located outside the hatch opening.

Figure 2:
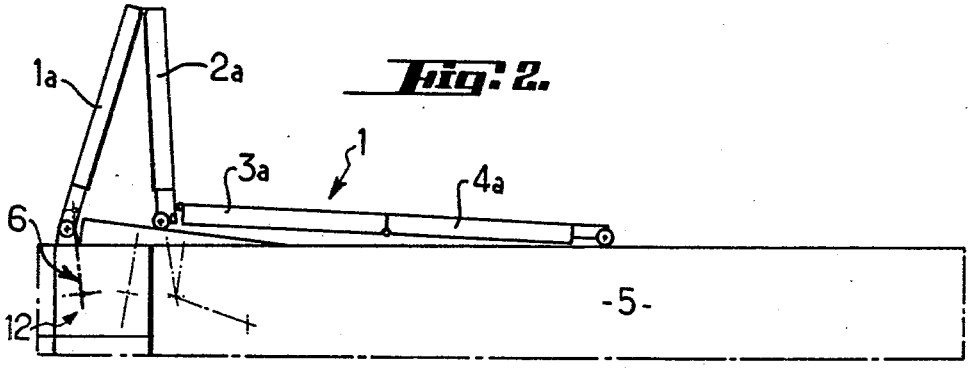
Figure 3:
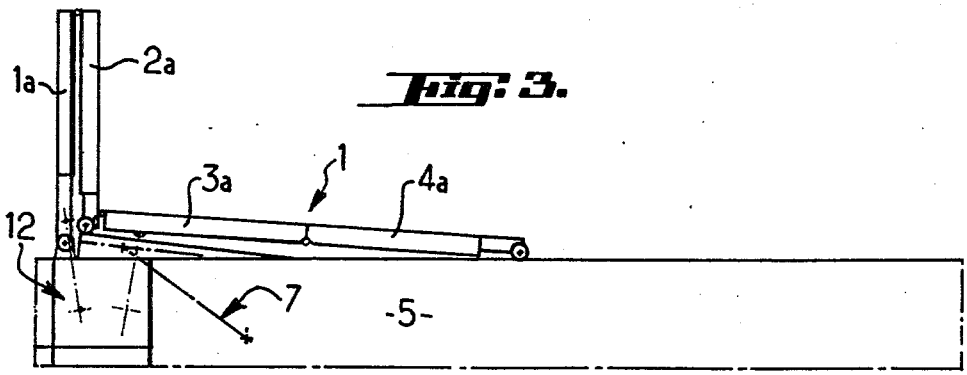
Figure 4:
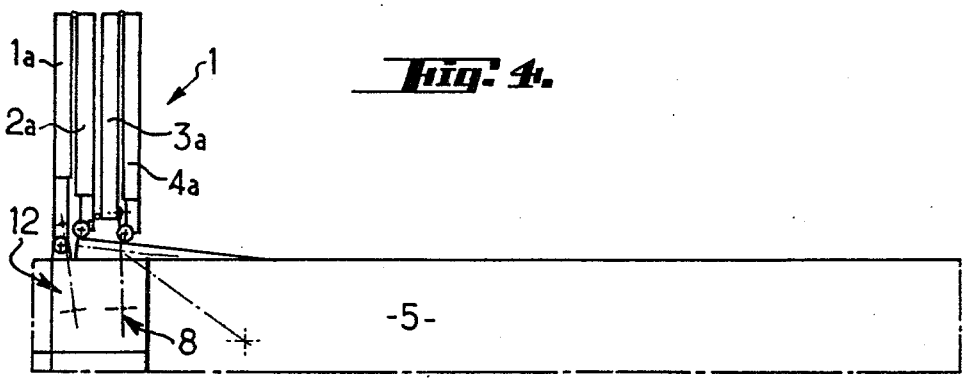
Figure 5:
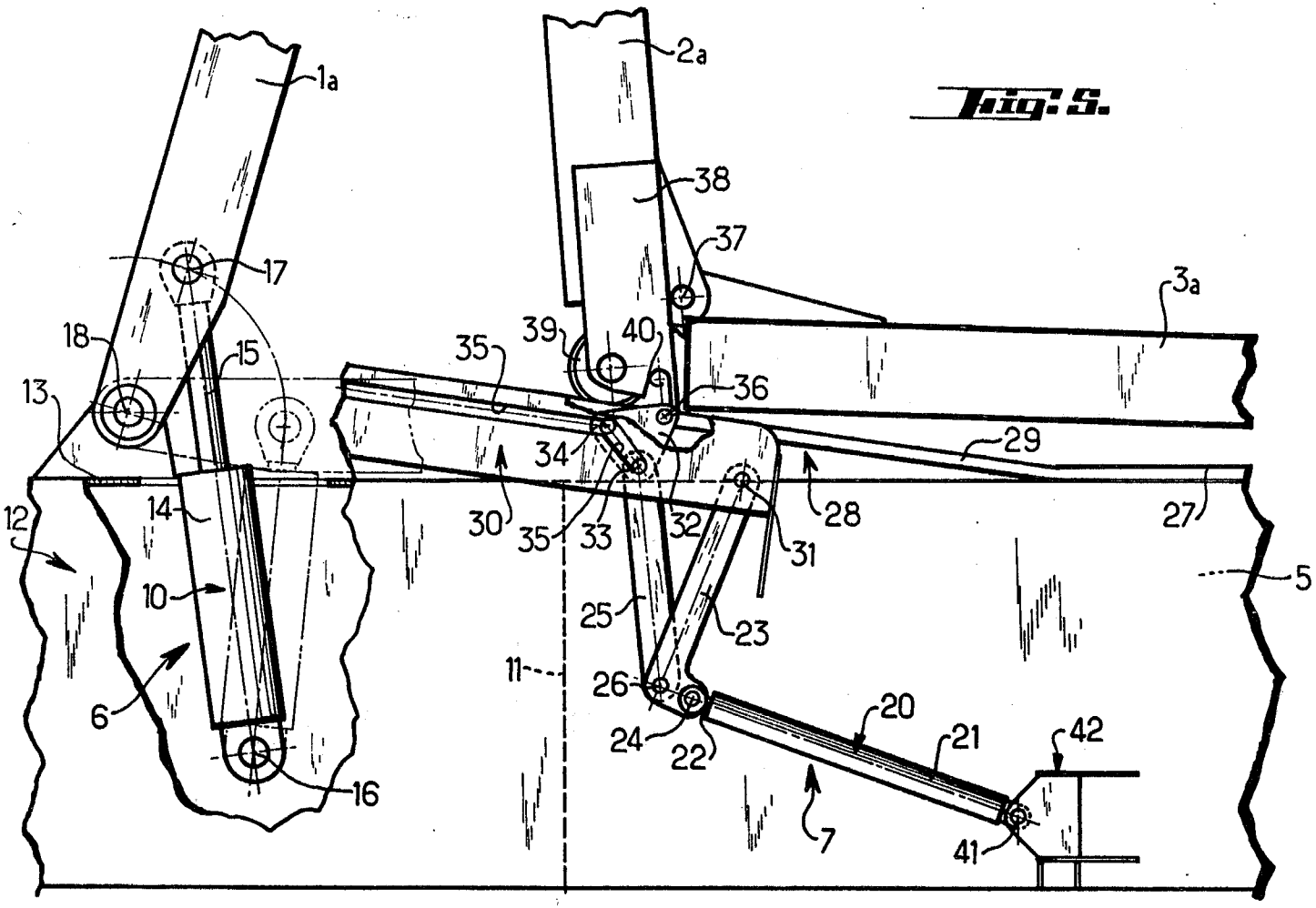
Figure 6:
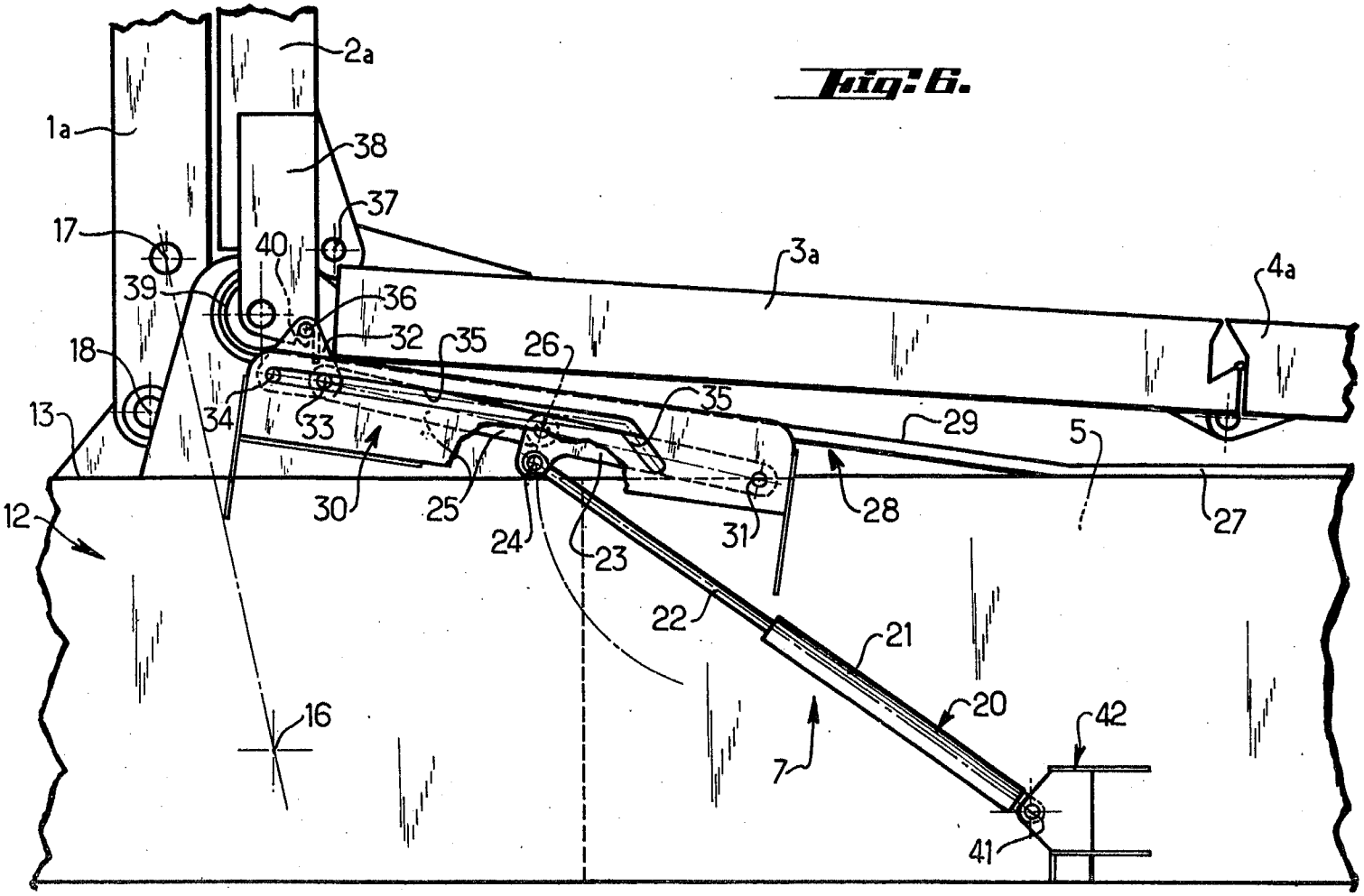
Figure 6:
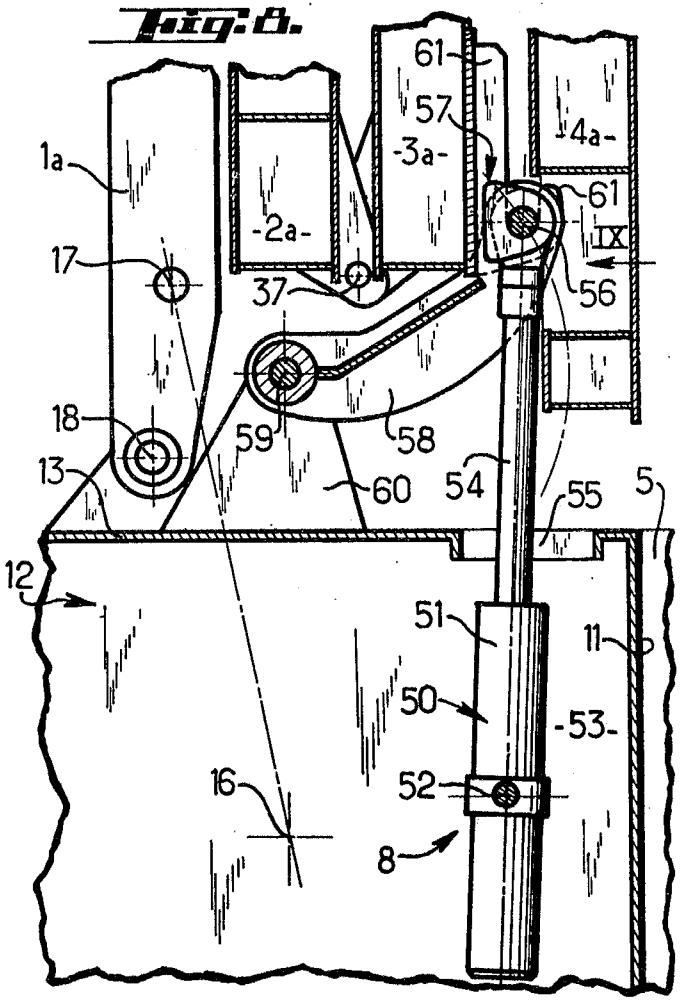
Figure 7:
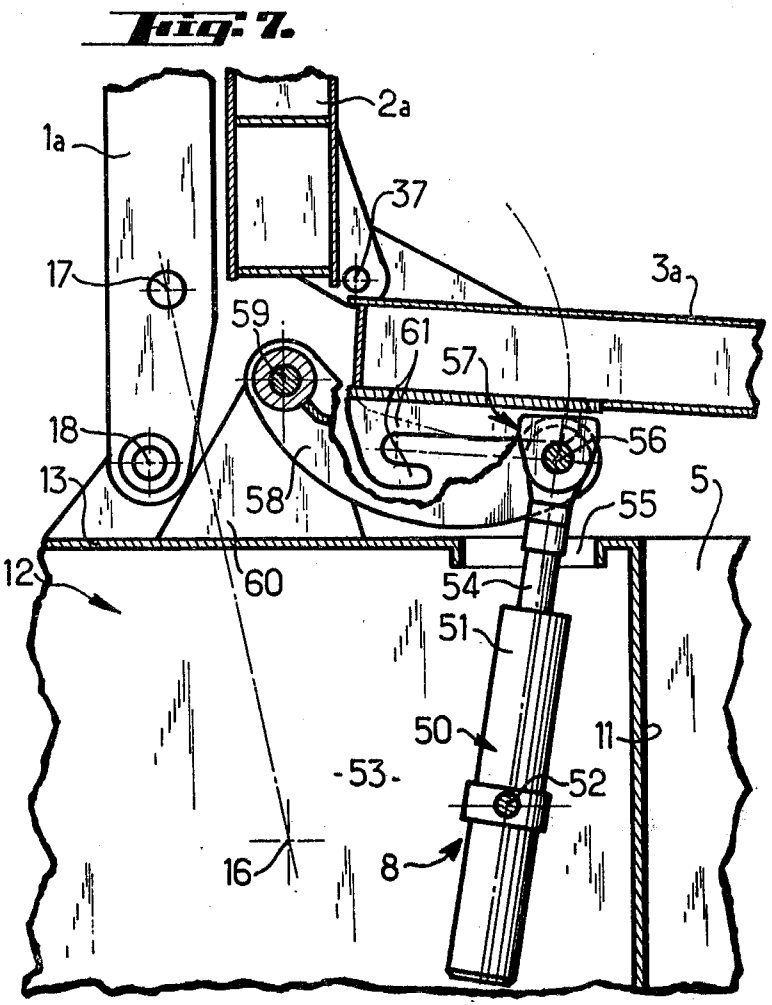
Figure 9:
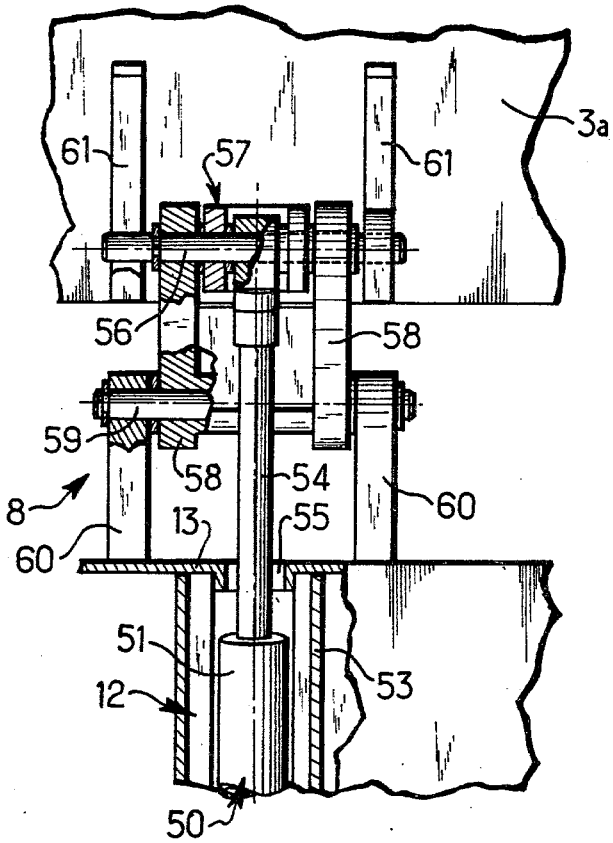
Figure 10:
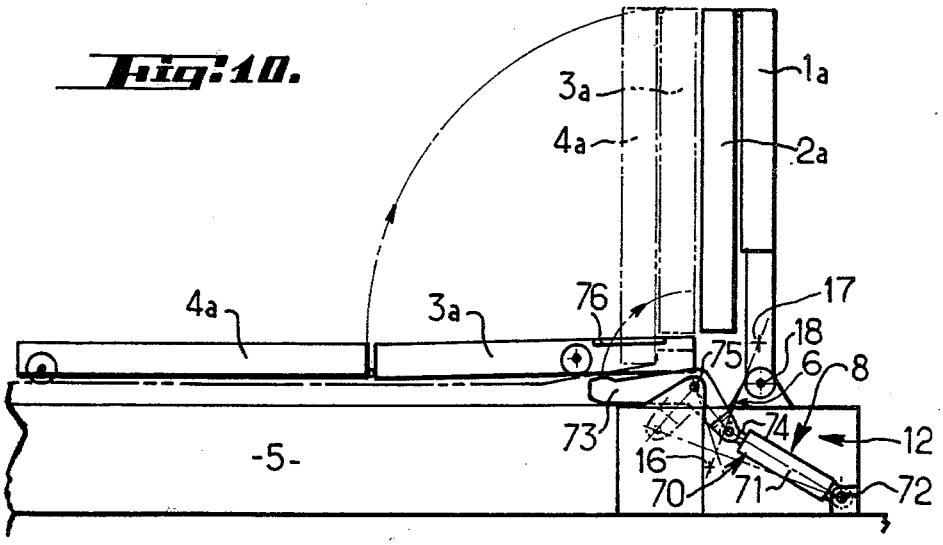

Other advantages, features and details of the invention will appear more clearly from the following explanatory description made with reference to the appended drawings given solely by way of example and wherein:

FIG. 1 is a diagrammatic elevational view of a hatch cover in its closed position, with the various operating means in their position of rest, FIG. 2 is a diagrammatic elevational view illustrating the first hatch-cover opening stage, with the two first cover panels partially folded, FIG. 3 is a diagrammatic elevational view illustrating the second hatch-cover opening stage, with the first two cover panels completely folded, FIG. 4 is a diagrammatic elevational view illustrating the last hatch-cover opening stage, with the two last panels in their folded position, FIG. 5 is an elevational, partially broken-away view illustrating the first and second operating means for folding the first two cover panels, wherein the said first operating means have operated whereas the second operating means are at rest, FIG. 6 is an elevational view illustrating the operation of the second operating means to move the two first cover panels to their completely folded position, FIG. 7 is a partial elevational view showing the third operating means of the two last cover panels in their position of rest, FIG. 8 is an elevational view showing the third operating means after they have acted upon the two last cover panels, FIG. 9 is a view in the direction of arrow IX of FIG. 8, FIG. 10 is an elevational view illustrating a second form of embodiment of the third operating means of the two last panels or sections of the hatch cover, which means offer the advantage of allowing the first two cover panels to be also completely folded, i.e. the second operating means to be dispensed with, and FIGS. 11 to 14 are diagrammatic elevational views which illustrate, respectively, the various steps necessary for folding the cover panels according to a third form of embodiment of the third operating means, which represents a modification of the second form of embodiment illustrated in FIG. 10.

FIGS. 1 to 4 diagrammatically illustrate the various operations which the operating means must perform to ensure the opening of a hatch cover 1 composed of four cover panels or sections 1*a*, 2*a*, 3*a* and 4*a* hingedly connected to one another so as to be foldable in the manner of an accordion beyond one of the end or transverse walls of a coaming 5 upon which rests the hatch cover 1 in its closed position.

In these Figures are diagrammatically represented the various operating means allowing the hatch cover to be handled, namely:

first operating means 6 for partially folding the cover panels 1*a*, 2*a* as shown in FIG. 2, second operating means 7 for completely folding the cover panels 1*a*, 2*a* as illustrated in FIG. 3, and third operating means 8 for folding the cover panels 3*a* and 4*a* as illustrated in FIG. 4.

The said operating means are essentially constituted by pneumatic or hydraulic actuators or fluid-operated cylinders, which will be described in more detail hereunder.

The first and second operating means for handling the panels 1*a* and 2*a* will be described with reference to FIGS. 5 and 6.

The first operating means 6 comprise by a pair of actuators 10 (only one of which is shown) mounted beyond the end or transverse wall 11 of the hatch coaming. More precisely the first operating means 6 are located in a compartment 12, the sidewalls of which extend in prolongation of those of the coaming 5 and which is closed by an upper plate 13 provided with holes to allow for mechanical connections between the first operating means 6 and the cover panel 1*a* actuated thereby. Each actuator 10 has the end of its cylinder 14 opposite to the piston rod 15 pivoted about a substantially horizontal pin 16 secured to the wall of the compartment 12 through the medium of a vertical plate (not shown) located within the said compartment. The free end of the piston rod 15 of each actuator 10 is pivoted about a substantially horizontal pin 17 supported by the cover panel 1*a* through the medium of, for example, a clevis, yoke or the like (not shown). The panel 1*a* is itself pivoted about a substantially horizontal pin 18 supported for example by two clevises or the like (not shown) secured to the upper plate 13 of the compartment 12 extending in prolongation of the hatch.

The pivot pins 16, 17, and 18 are substantially parallel with the coaming end-wall 11 and with the other pivot pins of the cover panels, so as to permit folding the panels in planes perpendicular to the side walls of the coaming 5.

The second operating means 7, which will now be described with reference to FIGS. 5 and 6, also comprise a pair of actuators 20 (only one of which is shown) mounted, respectively, externally of the mutually opposite side-walls of the coaming 5 and in parallel relationship thereto. Each actuator 20 has the end of its cylinder 21 opposite to its piston rod 22 pivoted about a substantially horizontal pin 41 parallel with the pivot pins 16, 17 and 18 and supported for example by a clevis or the like 42 secured to the side wall of the coaming 5. The end of the piston rod 22 of each actuator 20 is hingedly connected to one end of a substantially rectilinear link 23 through the medium of a pivot pin 24. A second link 25 is hingedly connected to the first link 23 by means of a pivot pin 26 arranged in substantially parallel relationship and in proximity to the pivot pin 24, so that the actuator 20 actuates both links 23 and 25 simultaneously.

Before proceeding to described the connection of the free ends of the links 23 and 24 it is important to point out, referring again to FIGS. 5 and 6, that the rolling track or runway for the hatch cover 1 along each coaming rail or bar 27 mounted on top of each of the mutually opposite side walls of the coaming 5 is extended beyond the transverse wall 11 of the coaming 5 by an ascending ramp or upgrade 28 whose upper surface serves as a rolling track or runway 29. In parallel relationship to each ramp 28 is externally secured a member 30 extending the whole length of the ramp 28 and so spaced therefrom that the plane defined by each actuator 20 and the corresponding links 23 and 25 passes through the said space between each member 30 and each ramp 28.

The free end of each link 23 is pivoted about a fixed, substantially horizontal pin 31 parallel with the horizontal pivot pin 24 of each cylinder 21 and supported by the member 30. The other end of each link 25 is hingedly connected to a triangular member 32. More precisely the other end of, each of the links 25 is pivoted about a substantially horizontal pin 33 in proximity to one of the vertices of the triangular member 32. At another vertex of the triangular member 32 is provided a horizontal guiding pin 34 parallel with the pivot pin 33 and both pins 33 and 34 are engaged in a slot 35 substantially parallel with the rolling track 29 of the associated ramp 28 and machined in the member 30. At the third vertex of the triangular member 32 is provided a pin 36 parallel with the pins 33 and 34, and the function of which will be explained later. All three pins 33, 34 and 36 are perpendicular to the triangular member 32 and project from a same side thereof. Each triangular member 32 is mounted in the corresponding spaced separating the respective member 30 and the ramp 28, so that its pins 33 and 34 can slide in the associated slot 35 in the member 30.

The cover panels 2*a* and 3*a* are hingedly connected to one another by means of a substantially horizontal pivot pin 37 parallel with the pivot pin 18 of the cover panel 1*a*. As also noted in FIGS. 5 and 6 the cover panel 2*a* is laterally extended by two arms 38 supporting at their end a wheel or roller 39 intended to roll on the associated coaming bar or rail 27 and ramp 29. Each arm 38 is provided towards its end with a groove 40 intended to receive the pin 36 of the associated triangular member 32. As will be seen later, this connection allows the cover panel 2*a* to be folded completely against the cover panel 1*a*, with pins 33 and 34 of the triangular member 32 then moving in the associated slot 35.

The third operating means allowing the cover panels 3*a* and 4*a* to be raised will now be described with reference to FIGS. 7 to 9. The third operating means 8 comprise two actuators 50 (only one of which is shown) mounted within the compartment 12 adjacent, respectively to by the two actuators 10 of the first operating means which also are housed within the compartment 12. Each cylinder 51 of the actuators 50 is pivoted substantially at its middle about a substantially horizontal pin 52 parallel with the pivot pins 16 and 41 of the cylinders 14 and 21 of the actuators 10 and 20 of the first and second operating means 6, 7, respectively. The pivot pin 52 is supported by a side wall of the compartment 12 and by an internal plate 53 mounted within the said compartment and parallel with the said side wall. The end of each piston rod 54 projects outside the compartment 12 through a hole 55 provided in the upper plate 13 of the said compartment and is pivoted about a pin 56 which supports a clevis or the like 57. About the pivot pin 56 and on either side of the clevis 57 are pivoted the ends of two curved links 58 connected with one another at their central portion. The other ends of the links are pivoted about a substantially horizontal pin 59 parallel with the pivot pin 56 and with those hingedly interconnecting the various cover panels. The pivot pin 59 is supported by a fixed clevis or the like 60 secured to the upper plate 13 of the compartment 12. On the lower surface or under-part of the cover panel 3*a* are provided, for each actuator 50, two claw or hook elements 61 arranged in parallel relationship to the longitudinal axis of the cover panel 3*a*, i.e. the longitudinal opening and closing direction of the hatch cover 1, so as to engage the pivot pin 56, which extends beyond the links 58, when the panel 3*a* is completely lifted, as will be seen later when describing the operation of the operating means.

A second form of embodiment of the third operating means 8, will now be described with reference to FIG.

10. These means are constituted by a pair of actuators 70 (only one of which is represented) mounted within the compartment 12 and having their cylinders 71 pivoted at the ends opposite their piston rods 74 about a substantially horizontal pivot pin 72 supported for example by two clevises or the like secured to the two side walls of the compartment 12, respectively. Each piston rod 74 is pivoted at the end of a bent intermediate member 73 about a substantially horizontal pin parallel with the pivot pin 72. The intermediate member 73 is pivoted substantially at the level of its bend about a fixed pivot pin 75. The other end of the intermediate member 73 is adapted to come into contact with a member 76 projecting sidewise from the cover panel 3a, so as to bear against the latter during the operation of the actuators 70 and thereby raise the cover panels 3a and 4a.

The operation of the device for handling the hatch cover 1 according to the invention will now be described with reference to the various Figures.

Starting from the position where the hatch cover 1 is closed, i.e. the cover panels 1a, 2a, 3a, 4a rest upon the hatch coaming 5, the cover panels 1a, 2a will first be partially raised by means of the first operating means 6 (position shown in FIG. 2). Referring to FIG. 5, the first operating means 6 will be actuated, i.e. hydraulic pressure will be applied to both actuators 10. The rest position of the actuators is shown in broken lines in FIG. 5. The pressure applied to the actuators 10 will cause the piston rods 15 to extend and push by their ends the cover panel 1a through the medium of the pivot pin 17 secured to the said cover panel, and the cover panel 1a will rotate about its pivot pin 18 supported by the upper plate 13 of the compartment 12.

Once the first operating means 6 have thus acted, the second operating means 7 will be brought into action to completely fold the cover panels 1a, 2a so as to move the latter to a position substantially parallel to one another and substantially perpendicular to the plane of the hatch (position illustrated in FIG. 3). Referring to FIG. 5, the second operating means are shown in their position of rest. The rods 22 of the actuators 20 are retracted and the links 23 and 25 form an acute angle to one another, whereas the triangular member 32 is located at the end of the slot 35 which is remotest from the cover panel 1a. At that moment the cover panels 3a and 4a have rolled on the coaming rails 27, and the rollers 39 between the cover panels 2a and 3a are located on the ramps 28, so that the cover panel 3a is slightly raised. When pressure is applied to the power cylinders 20, the rods 22 act upon the links 23 and 25 thus causing the two pins 33 and 34 of each triangular member 32 to move in the corresponding slot 35 under the scissor action of the corresponding link 23 and link 25. During this movement, each pin 36 of the triangular members moves into the respective groove 40 of the corresponding arm 38 connected with the cover panel 2a and thus drives the said cover panel upward on rolling track 29 as the triangular members are displaced along the respective slots 35. During this displacement the links 23 and 25 tend to become aligned with one another. FIG. 6 shows the position of the cover panels 1a and 2a after the actuation of the second operating means 7. As can be observed the links 23 and 25 are aligned with one another, the triangular members 32 have reached the other end of the associated slots 35, and the rollers 39 between the cover panels 2a and 3a have reached their highest position on the ramps 29. During this operation the cover panels 3a and 4a are still aligned with one another even though they have been displaced along the ramps 29 and the coaming rails 27, respectively.

The operation of the third operating means 8 allowing the cover panels 3a and 4a to be folded will now be described with reference to FIGS. 7 to 9. In FIG. 7 these panels are shown in their position of rest and ready to be actuated. After the cover panels 1a and 2a have been folded, the cover panel 3a has taken a position substantially beyond the actuators 50, thus allowing the latter to engage the cover panel 3a. More precisely, pressure is applied to the actuators 50 so that the external surface of each base element of the clevises 57 comes into contact with the lower surface of the cover panel 3a. Once this contact has taken place and with pressure is continuing to be applied to the actuators 50, the piston rods 54 raise the cover panel 3a while the clevises 57 are in sliding contact with the said cover panel. Since the pivot pins 56 of the clevises 57 are hingedly pivoted in the ends of the links 58 whose other ends are pivoted about the fixed pins 59, the links 58 are compelled to move along an arc of a circle in a vertical direction, thus causing the cover panel 3a to be raised in an arc about pivot pins 37, with the clevis 57 acting as a sliding shoe or pad to be moved onto the end surface of the cover panel 3a adjacent to the end surface of the cover panel 2a. As can be observed in FIG. 8 which shows the cover panels 3a and 4a completely folded, the hook elements 61 secured to the cover panel 3a have engaged the pivot pin 56 of the clevis 57, thus allowing the cover panels to be reliably held in position.

Of course the action of the third operating means 8 upon the cover panel 3a compels the end cover-panel 4a to fold against the cover panel 3a. Once the position shown in FIG. 4 is reached, the pressure can be removed from the first and second operating means 6, 7 and kept applied only to the third operating means 8, which can alone hold the cover panels in their folded position outside the periphery of the hatch and substantially above the compartment 12.

The operation of the second form of embodiment of the third operating means 8 will now be described with reference to FIG. 10. The folding of the cover panels 1a and 2a is performed in the same manner as previously. In order to fold the cover panels 3a and 4a pressure is applied to the actuators 70 to cause each intermediate member 73 to pivot about the fixed pivot pin 75 and allow the end of the intermediate member 73 opposite to the end hingedly connected to the corresponding piston rod 74 to come into contact with the corresponding one of the elements 76 projecting from either side of the cover panel 3a. Once this contact is made, the action of the actuator 70 causes the cover panel 3a, and also the cover panel 4a, to fold up. It should be noted that the elements 76 must have a predetermined length since the ends of the intermediate members 73 are in sliding contact with the said elements. Compared with the foregoing form of embodiment of the third operating means 8, the role played by the intermediate elements 73 is similar to that of the clevises 57 and links 58.

It is important to note that in this form of embodiment the second operating means are not necessary. Indeed, once the first operating means have acted to partially fold the first two cover panels, the structure of the third operating means maybe such that they can directly be brought into action to fold the two last cover panels and at the same time completely fold the two first cover panels as a result of the reaction of the third panel against the second panel towards the end of the travel of the rods 74 of the actuator 70. So, the second operating means can be dispensed with, as shown in the embodiment of FIGS. 11-14, and consequently the structure of the device considerably simplified.

The invention thus allows the operating means for the handling of the hatch cover 1 to be advantageously placed outside the periphery of the hatch, without requiring a permanently free or cleared longitudinal space to be provided along the side walls of the coaming. This, in addition, reduces the risk of accidents.

Such operating devices offer considerable advantages, especially in the case of transportation of goods such as paper, since the absence of any hydraulic device within the periphery of the hatch avoids damaging of the paper by possible oil leakage.

Of course such handling devices may be adapted for cover panels other than those of ship's hatches and they can be quite as well used in land installations.

Figure 11:
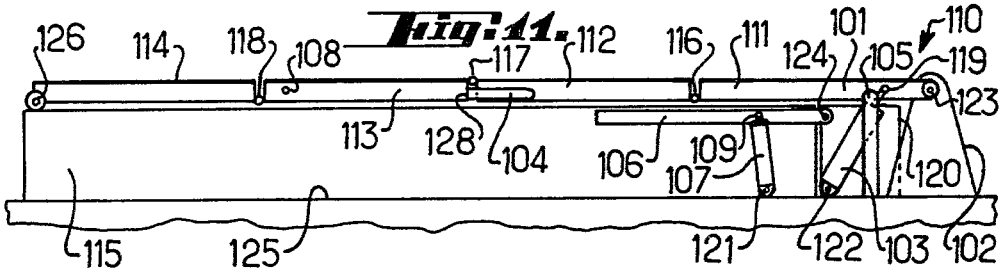

Now referring to FIG. 11, there is shown a hatch cover 110 according to the present invention including four panels 111, 112, 113 and 114 placed in parallel on top of a hatch coaming 115. A storage station 120 is located on deck 125 adjacent to right end of the hatch coaming 115. For convenience, those four panels 111, 112, 113 and 114 are respectively referred to as first, second, third and fourth panel looking from the storage status 20. Each of the first, second and third panels 111, 112 and 113 is hingedly connected to the adjacent subsequent panel by means of hinge members 116, 117 and 118, respectively. The first panel 111 is provided with an arm 101 extending therefrom at its righthand end. The arm 101 is pivotally connected to a bracket 112 on the deck 125 at the outer end thereof by means of a horizontal pin 123. Actuating means such as a hydraulic cylinder 103, has one end connected to the deck 125 by means of a pivot pin 122 and the other end of the arm 101 by means of a pivot pin 119 so as to cause the first panel 111 to be pivoted about the pivot pin 122. The fourth panel 114 is provided with a roller 126 rolling along a rail (not shown) on top of the hatch coaming 115. The second and third panels 112, 113 are also provided respectively with similar rollers (not shown).

Figure 12:
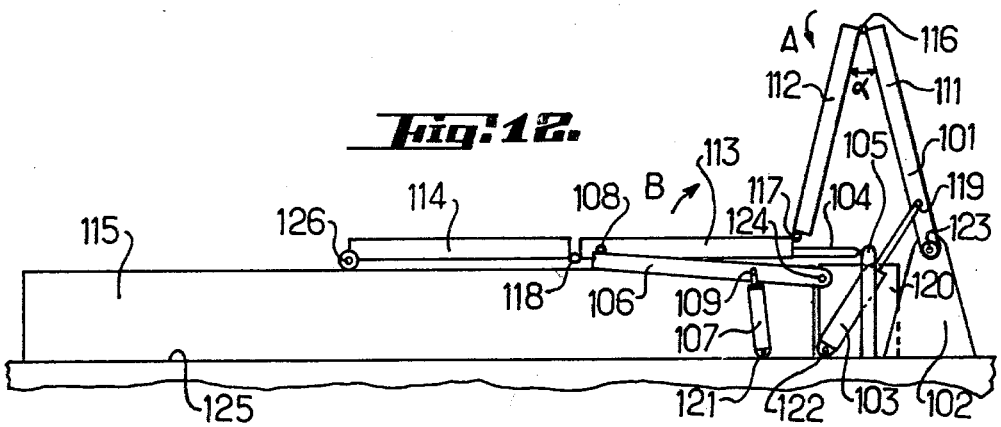

In the hatch cover 110 according to the present invention, a positioning bar 104 of predetermined length is mounted on the third panel 113 on end surface 128 adjacent to the second panel 112. One positioning bar 104 is provided to each side of the third panel 113 and extends perpendicularly to the end surface 128. As shown in FIG. 12, when the first and second panel 111, 112 are erected into an upright A-shaped configuration slightly before vertical storage position by action of the actuating means 103, third panel 113 is dragged rightward along the rail on top of the hatch coaming 115 and approaches the storage station 120. At this time, the righthand end of the positioning bar 104 will abut a stopper post 105 which is mounted on the deck 125 at predetermined location. The second panel 112, erected together with the first panel 111 in the form of a litter A as shown in FIG. 2, tends to rotate counterclockwise in the direction indicated by arrow A about the hinge member 116 by gravity, but will be stopped at a position where an angle formed between the first and second panels 111, 112, reaches a predetermined value, the inertia of subsequent panels 113 and 114 and friction the rollers provided on those panels and the rail on the hatch coaming. The length of the positioning bar 104 and location of the stopper post 5 are selected such that the positioning bar 104 will abut the stopper post 105 before the angle $\alpha$ reaches the above-mentioned predetermined value. That is to say, the positioning bar 4 will abut with the stopper post 105 at a point where the second panel 112 has still some room to pivot counterclockwise in the direction of arrow A about the hinge 116. This positioning means that the second panel 112 will be assisted in its folding operation against the first panel 111 by action of the third panel 113 which is actuated by swinging levers 106 to be described hereinafter.

The hatch cover 110 according to the present invention is further provided on each side with a swinging lever 106 of predetermined length pivotally connected to the deck. The swinging lever 106 has one end pivotally connected to a suitable support member mounted on the hatch coaming 115 or on the deck 125 by means of a pivot pin 124. Another actuating means, such as a hydraulic cylinder 107, having one end connected to the deck 125 by a pivot pin 121 and the other end to the swinging lever 106 at an intermediate portion thereof by means of a pivot pin 109, is provided for causing the swinging lever 106 to be pivoted about the pivot pin 124.

Figure 13:
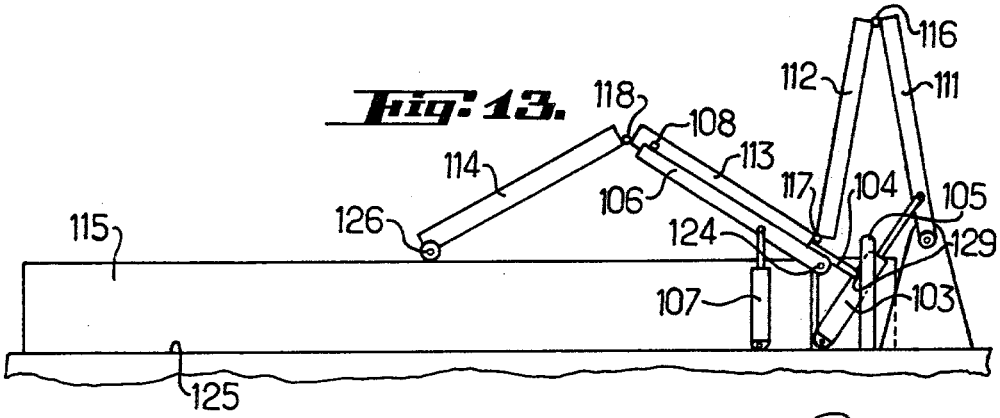
Figure 14:
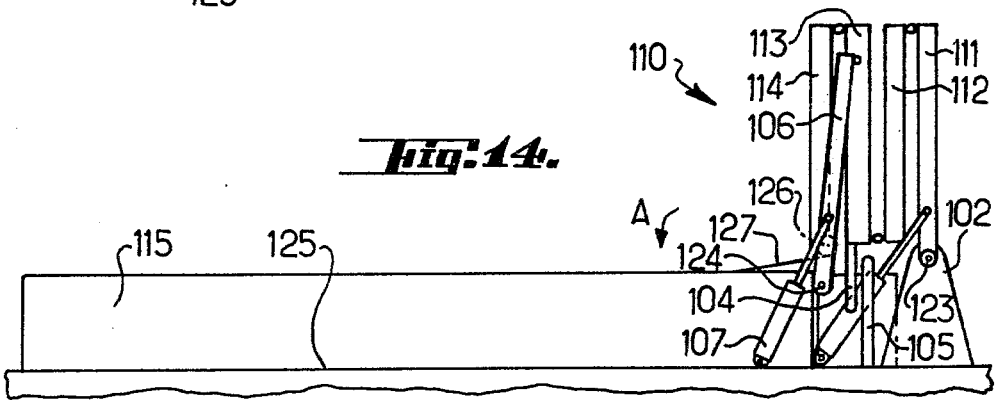

As shown in FIG. 12, a stud 108 is mounted on the third panel 113 on each side at a point adjacent to an end opposite to the end where the positioning bar 104 is mounted. When the swinging lever 106 is rotated clockwise in the direction indicated by arrow B about the pivot pin 124 by action of the actuating means 107, the swinging lever 106 will engage with the stud 108 on the third panel 113, which is dragged along to a position adjacent to the storage station 120 with the positioning bar 104 in abutment with the stopper post 105, and will cause the third panel 113 to be rotated clockwise in the direction of arrow B about the hinge member 117 as shown in FIG. 13 and further to be folded upon the second panel at the storage station 120 as shown in FIG. 14. During this time, the swinging lever 106 will push the hinge 117, that is, the lower end of the second panel 112 in FIG. 12, toward the first panel 111, thereby enabling the second panel 112 to be completely folded against the first panel 111. Hence the swinging lever 106 will fold not only the third panel 113 against the second panel 112, but also the second panel 112 against the first panel 111 at the storage station 120. In the stored condition of all panels, as shown in FIG. 14, the fourth panel 114 is suspended from the hinge 118 on top of the third panel 113, which is erected upright, with the roller 126 mounted on the fourth panel 114 at its lower end engaged with a ramp 127. When all panels 111, 112, 113 and 114 are folded together at the storage station 120, they are fastened to a suitable supporting post member (not shown) by a length of lashing wire (not shown), and the swinging lever 106 is brought back to horizontal position as shown in FIG. 11.

When closing the hatch coaming 115, first the lashing wire is released from the hatch cover 110 which is folded together at the storage station 120 as shown in FIG. 14, and then the third panel 113 will rotate counter-clockwise in the direction of arrow A about the hinge member 117 Simultaneously the roller 126 at the lower end of the fourth panel 114 will roll along the ramp 127, thereby causing the lower ends of the third and fourth panels 113, 114 to be spread apart in the shape of a letter A, thus bringing both panels 113 and 114 into a condition as shown in FIG. 13. The positioning bar 104 mounted on the third panel 113 is in abutment with the stopper post 105 in the condition as shown in FIG. 13 and then is rotated counterclockwise about a point 129 where the outer end of the positioning bar 104 is in contact with the stopper post 105 thus rotation will pull the hinge member 117 leftward from the position in FIG. 13, thereby causing the lower ends of the first and second panels 111 and 112 to be spread apart in a shape of the letter A, thus enhancing a hatch closing operation and bringing all the panels 111, 112, 113 and 114 in the condition as shown in FIG. 12. At this point, the actuating means 103 will be operated to unfield the panels 111 and 112 on top of the hatch coaming 115 to close the hatch opening as shown in FIG. 11.

What is claimed is:

1. Operating apparatus for a folding cover system for a shipboard hatch coaming or the like having two parallel side walls and two end walls, the system including at least three rectangular cover panels, each panel being hingedly connected at one edge to an adjacent edge of the next panel, and a first one of the panels being hingedly connected at the edge opposite said one edge to a fixed support adjacent to one end wall of the coaming, the operating apparatus being actuable for moving the panels between a covering position in which the cover panels rest substantially in a common plane on the rim of the coaming and a stowage position in which the panels are folded together about said hinged connections to a substantially upright position adjacent to said one end wall of the coaming and including operating means for pivoting the first panel about the fixed support to an approximately upright position, thereby at least partially folding the second panel against the first panel, and means for folding the third cover panel about its hinged connection with the second panel, wherein the means for folding the third panel comprises:

at least one lever mounted for pivoting about an axis adjacent and parallel to said one end wall of the coaming, the lever having a bearing means with a surface spaced from the pivot axis for slidably contacting the under surface of a portion of the third cover panel at a location spaced from the hinged connection between the third and second panels when said first and second panels are in said at least partly folded upright position, and actuating means, hingedly connected to the lever at an actuating point spaced from the pivot axis, for pivoting the lever into contact with the third panel and then folding said panel upward toward the folded second panel about the hinged connection between said panels, with the surface of said bearing means being free to slide against the under surface of said portion of the third panel as said third panel is being folded upward against the second panel.

2. Apparatus according to claim 1, wherein said lever is mounted outside one of the side walls of the coaming, and said portion of the third cover slidably contacted by the surface of the bearing means comprises a plate projecting laterally from the corresponding side edge of the third cover panel.

3. Apparatus according to claim 1 wherein said at least one lever comprises two levers, each lever being mounted outside a respective side wall of the coaming for pivoting about said axis.

4. Apparatus according to claim 3, wherein said two levers are located beyond the one end wall of the hatch coaming, between said end wall and a location of the operating means for folding the first and second cover panels.

5. Apparatus according to claim 1, wherein said bearing means comprises a clevis means pivotally attached to the lever at a point spaced from the pivot axis of the lever, and the actuating means comprises a hydraulic piston and cylinder connected between said pivot point of the clevis means and a fixed foundation member.

6. Apparatus according to claim 5, wherein each lever comprises two curved, substantially parallel links interconnected at their central portion and pivoted at one end about a stationary pin coaxial with said pivot axis and having a pivot pin at the other end supporting the bearing means and secured to one end of the actuator piston and cylinder.

7. A device according to claim 6, wherein said third cover panel is provided on its lower face with at least one pair of substantially parallel hook elements arranged in perpendicular relationship to the hinged edges of the cover panels and adapted to receive the clevis pivot pin of a respective lever when the third cover panel is folded.

8. Apparatus according to claim 7, wherein, in the folded position of the said third cover panel, the clevis of each lever is located in proximity to the edge of the third panel which is hingedly connected to the second cover panel.

9. Apparatus according to claim 1, wherein said actuator means is pivotally connected to a fixed foundation structure.

10. Apparatus according to claim 9, wherein said lever is mounted at one end for pivoting about said axis, and the bearing means is located at a free end of the lever.

11. Apparatus according to claim 10, wherein said portion of the third cover panel comprises at least one driving pin projecting from a side edge of the third cover panel, and the bearing means of said lever slidably contacts said pin to fold the said third cover panel.

12. Apparatus according to claim 11, wherein said third cover panel comprises at least one positioning element extending in prolongation of at least one side edge of said third cover panel from the edge hingedly connected to the second cover panel to a free end.

13. Apparatus according to claim 12, wherein the free end of said positioning element bears against a stop means positioned adjacent to the one end wall of the coaming to start the folding of the third cover panel.

14. Apparatus according to claim 13, wherein said means positioning elements bears against said associated stop means while the second cover panel is only partially folded.

15. Apparatus according to claim 14, wherein the second cover panel is completely folded through the medium of the actuation of said lever, at which point said positioning element is no longer in contact with the associated stop means.

16. Apparatus according to claim 15, wherein said at least one positioning element comprises two positioning elements mounted one on each side of said third cover panel said stop means comprises two associated stops, respectively, and said actuator means comprises two actuators, respectively.

17. Apparatus according to claim 1, wherein a line from the pivot axis of said lever to said contact surface of the bearing means makes an obtuse angle with a line from the pivot axis to said actuating point.

18. Apparatus according to claim 17, wherein said lever comprises a member having two angled arms, one of said arms extending from said pivot axis to a free end comprising said bearing means, and the other of said arms extending from said pivot axis to said actuating point.

19. Apparatus according to claim 18, wherein said actuating means comprises a linear actuator having one end pivotally connected to the actuating point of said lever and an opposite end pivotally connected to a point on a foundation means, said foundation point being located such that the line of thrust of said actuator is perpendicular to the other arm of said lever at one position during the operation of folding said third cover panel upward against said second cover panel.

20. Apparatus according to claim 18, wherein said pivot axis is approximately at the level of the contact surface of the bearing means at the start of folding the third cover panel and is spaced below the axis of the hinged connection between the second and third cover panels, whereby the location of the sliding contact between the bearing means and the under surface of said portion of the third cover panel is at a maximum distance from the axis of the hinged connection between the second and third cover panels when the third cover panel is resting on the coaming and is at a minimum distance from said axis when the third cover panel is folded upward against the second cover panel.

* * * * *

UNITED STATES PATENT AND TRADEMARK OFFICE

CERTIFICATE OF CORRECTION

PATENT NO. : 4,193,439

DATED : 18 March 1980

INVENTOR(S) : Henri Kummerman

It is certified that error appears in the above—identified patent and that said Letters Patent is hereby corrected as shown below:

Column 1, line 7: change "type" to --types--;
Column 3, line 4: after "comprise" delete --by--;
Column 3, line 68: after "precisely" insert --,--;
Column 4, line 1: after "of" delete ",";
Column 4, line 14: change "spaced" to --space--;
Column 4, lines 35-36: change "respectively to by" to --respectively, to--;
Column 5, line 52: change "scissor" to --scissors--;
Column 6, line 15: before "continuing" delete "is";
Column 7, line 27: change "status 20" to --station 120--;
Column 7, line 36: change second occurrence, "of" to --to--;
Column 7, line 47: change "to" to --on--;
Column 7, line 58: change "litter" to --letter--;
Column 7, line 62: after "angle" insert --∝--;
Column 7, line 64: after "friction" insert --between--;
Column 8, line 61: after "117" insert --.--;
Column 9, line 3: change "105 thus" to --105. This--;
Column 9, line 11: change "unfield" to --unfold--.

Signed and Sealed this

*Twenty-ninth* Day of *July 1980*

[SEAL]

*Attest:*

SIDNEY A. DIAMOND

*Attesting Officer*

*Commissioner of Patents and Trademarks*